US005653068A

United States Patent [19]

Moody et al.

[11] Patent Number: 5,653,068

[45] Date of Patent: Aug. 5, 1997

[54] WATER DIVERTING STRIP

[76] Inventors: Ben A. Moody; Gene W. Moody, both of P.O. Box 768, Oxergaard, Ariz. 85933

[21] Appl. No.: 638,822

[22] Filed: Apr. 29, 1996

[51] Int. Cl.[6] ..... E04D 13/00

[52] U.S. Cl. ..... 52/97; 52/11; 52/209; 49/408

[58] Field of Search ..... 52/97, 209, 11; 49/408

[56] References Cited

U.S. PATENT DOCUMENTS

| | | | |
|---|---|---|---|
| D. 301,165 | 5/1989 | Rose et al. . | |
| D. 347,682 | 6/1994 | Kennedy et al. . | |
| 349,894 | 9/1886 | McKenzie | 52/97 |
| 352,290 | 11/1886 | Bates | 52/97 |
| 827,456 | 7/1906 | Loeffler et al. | 52/11 X |
| 929,684 | 8/1909 | Mills et al. | 52/11 |
| 3,248,827 | 5/1966 | Hardy | 52/97 X |
| 3,653,711 | 4/1972 | De Claire et al. | 52/11 X |
| 4,416,835 | 11/1983 | Bosue | 52/11 X |
| 4,446,655 | 5/1984 | Unterhoffer et al. . | |
| 4,637,183 | 1/1987 | Metz . | |
| 5,170,597 | 12/1992 | Stearns . | |
| 5,321,921 | 6/1994 | Holt . | |

FOREIGN PATENT DOCUMENTS

| | | | |
|---|---|---|---|
| 0042565 | 2/1910 | Austria | 52/97 |

*Primary Examiner*—Carl D. Friedman
*Assistant Examiner*—Winnie Yip

[57] ABSTRACT

The present invention relates to a water diverting strip which is adapted to be affixed to a door jamb over a door way. This strip functions is routing water away from the door opening. In its broadest context, the strip includes two identical halves, with each half including a mounting portion, an extension portion and a trough. The trough is adapted to extend outwardly over the entrance way of a door. Additionally, the first and second halves of the trough are sloped away from one another to faciliate water drainage away from the door opening.

1 Claim, 3 Drawing Sheets

FIG 4
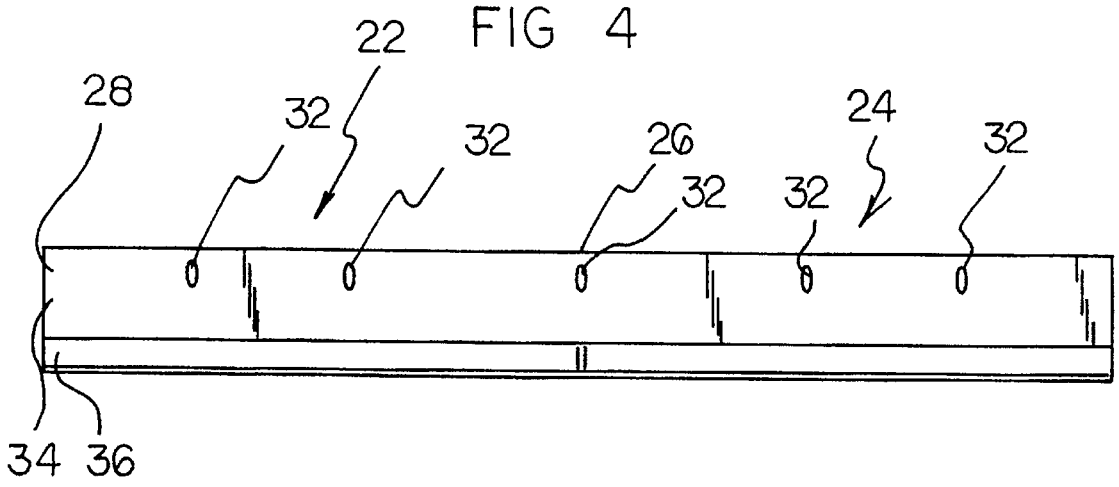
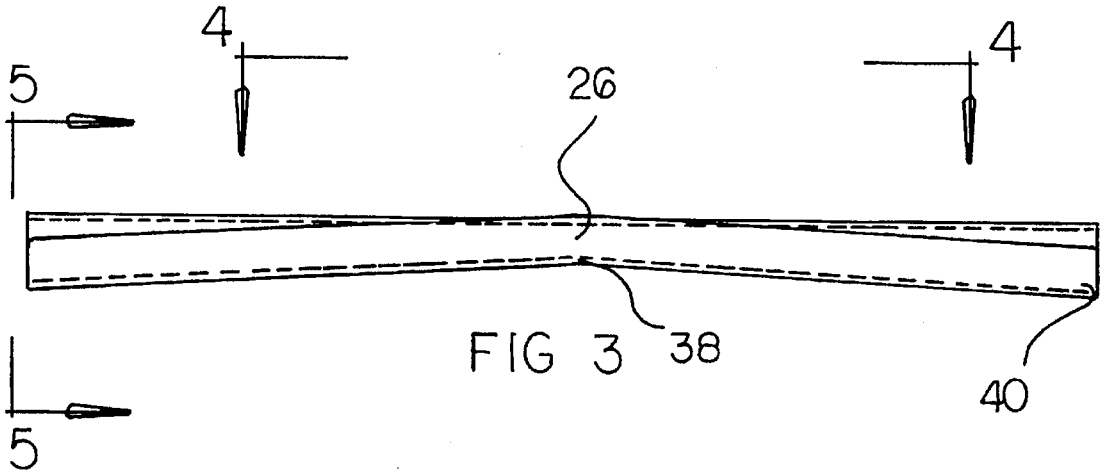
FIG 3

FIG 5
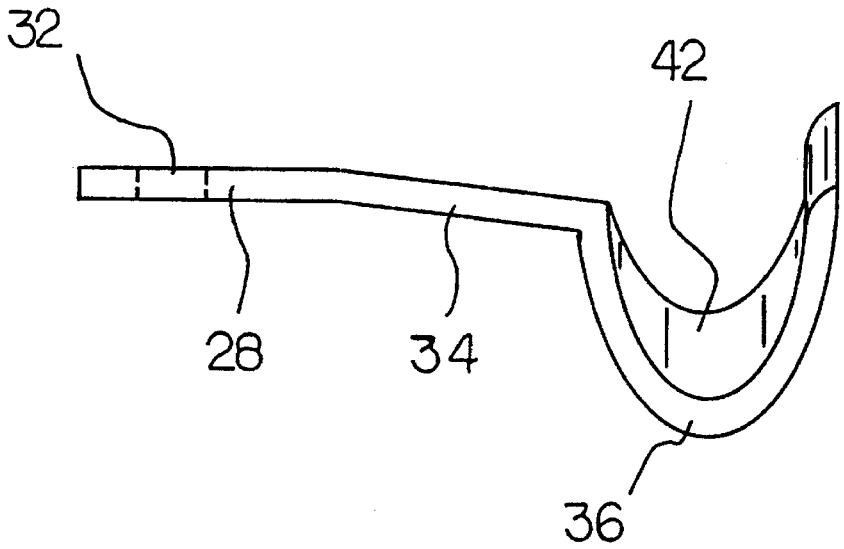
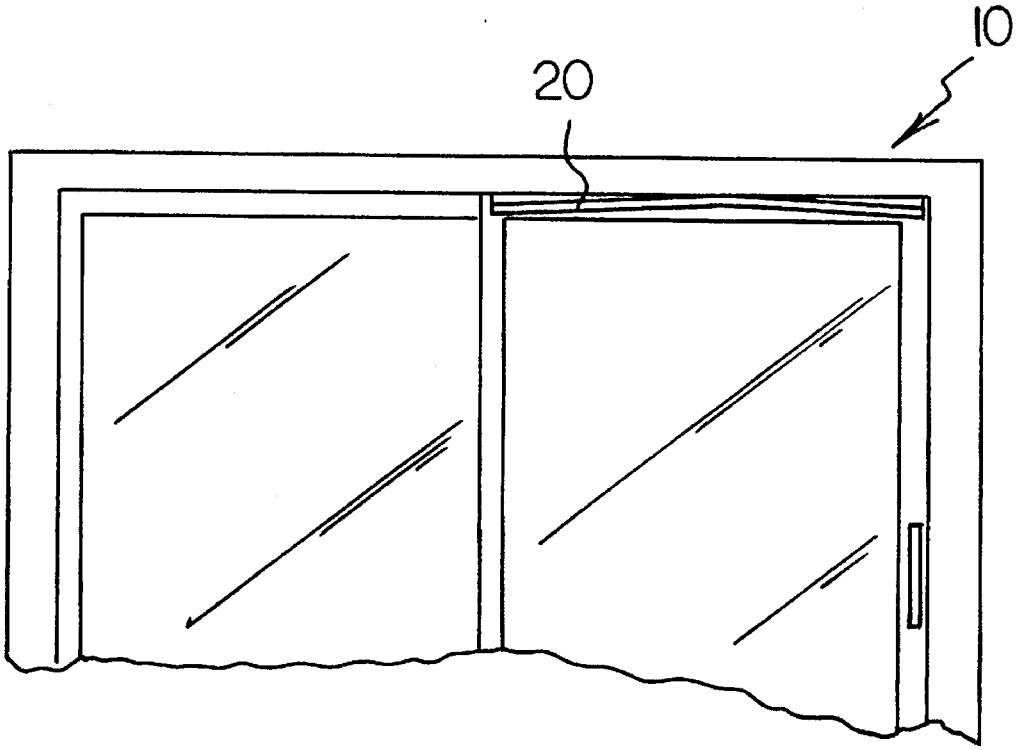
FIG 6

WATER DIVERTING STRIP

BACKGROUND OF THE INVENTION

1. Field of the Invention

The present invention relates to water diverting strip and more particularly pertains to a means of routing water away from a door opening.

2. Description of the Prior Art

The use of gutters is known in the prior art. More specifically, gutters heretofore devised and utilized for the purpose of routing water are known to consist basically of familiar, expected, and obvious structural configurations, notwithstanding the myriad of designs encompassed by the crowded prior art which has been developed for the fulfillment of countless objectives and requirements.

For example, U.S. Pat. No. 5,170,597 to Stearns discloses a roof flashing with an improved drip guard; U.S. Pat. No. 5,321,921 to Holt discloses a metallic radius drip cap for guarding window frames; U.S. Pat. No. Des. 347,682 to Kennedy et al discloses a gutter construction; U.S. Pat. No. 4,637,183 to Metz discloses a Frame for Door or Window Openings; U.S. Pat. No. 4,446,655 to Unterhoffer et al discloses a wetherproof double door structure for an enclosure embodying such a structure; lastly, U.S. Pat. No. Des. 301,165 to Rose et al. discloses a gutter construction.

In this respect, the water diverting strip according to the present invention substantially departs from the conventional concepts and designs of the prior art, and in doing so provides an apparatus primarily developed for the purpose of routing water away from a door opening.

Therefore, it can be appreciated that there exists a continuing need for new and improved water diverting strip which can be used for routing water away from a door opening. In this regard, the present invention substantially fulfills this need.

SUMMARY OF THE INVENTION

In view of the foregoing disadvantages inherent in the known types of gutters now present in the prior art, the present invention provides an improved water diverting strip. As such, the general purpose of the present invention, which will be described subsequently in greater detail, is to provide a new and improved water diverting strip and method which has all the advantages of the prior art and none of the disadvantages.

To attain this, the present invention essentially comprises a water diverting strip adapted to be secured over a doorway to divert water therefrom, the strip comprises the following elements. A first side, a second side and an median therebetween, each of the sides comprises the following elements. A rearward mounting portion having a first edge, a second edge. The rearward mounting portion is substantially planar and having a number of mounting holes formed through its thickness intermediate the first and second edges. An extension portion having a first edge, a second edge, and an intermediate extent therebetween, with the first edge of the extension portion being integral with the second edge of the rearward mounting portion, the intermediate extent being approximately 1 inch in length and sloping downwardly from the first edge toward the second edge. A trough having a proximal end adjacent the median of the strip, and a distal end opposite the proximal end, a first edge, a second edge and an intermediate arcuate extent positioned in between the first and second edges. The trough being angled downwardly from the proximal toward the distal end, the second edge of the trough being beveled to route water therein.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved water diverting strip which have all the advantages of the prior art gutters and none of the disadvantages.

It is another object of the present invention to provide new and improved water diverting strip which may be easily and efficiently manufactured and marketed.

It is further object of the present invention to provide new and improved water diverting strip which are of durable and reliable constructions.

An even further object of the present invention is to provide new and improved water diverting strip which are susceptible of a low cost of manufacture with regard to both materials and labor, and which accordingly are then susceptible of low prices of sale to the consuming public, thereby making such water diverting strip economically available to the buying public.

Still yet another object of the present invention is to provide new and improved water diverting strip which provide in the apparatuses and methods of the prior art some of the advantages thereof, while simultaneously overcoming some of the disadvantages normally associated therewith.

Even still another object of the present invention is to provide a retrofit device which routes water away from a door opening.

Lastly, it is an object of the present invention to provide new and improved a water diverting strip which is adapted to be affixed to a door jamb over a door way. This strip functions is routing water away from the door opening. In its broadest context, the strip includes two identical halves, with each half including a mounting portion, an extension portion and a trough. The trough is adapted to extend outwardly over the entrance way of a door. Additionally, the first and second halves of the trough are sloped away from one another to facilitate water drainage away from the door opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an elevational view of the strip in accordance with the present invention.

FIG. 4 is a plan view of the strip.

FIG. 5 is a view taken along line 5—5 of FIG. 3.

FIG. 6 is view of the strip employed on a sliding door.

The same reference numerals refer to the same parts through the various Figures.

DESCRIPTION OF THE PREFERRED EMBODIMENT

Figure 1:
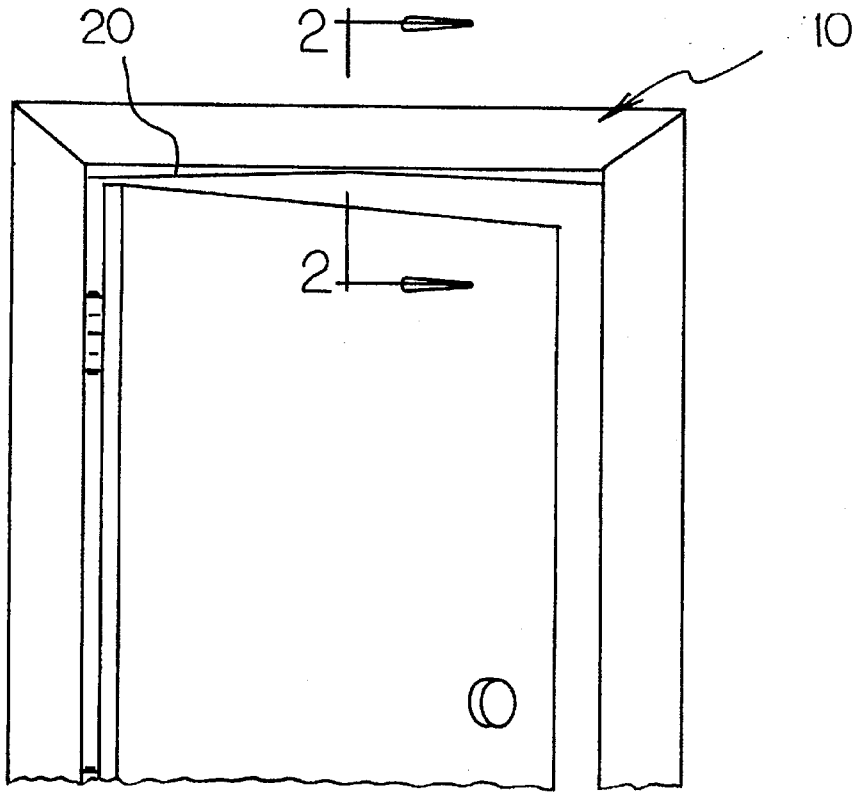
FIG. 1 is an elevational view of the preferred embodiment of the water diverting strip constructed in accordance with the principles of the present invention.

With reference now to the drawings, and in particular to FIG. 1 thereof, the preferred embodiment of the new and improved water diverting strip embodying the principles and concepts of the present invention and generally designated by the reference numeral 10 will be described.

The present invention relates to a water diverting strip which is adapted to be affixed to a door jamb over a door way. This strip functions is routing water away from the door opening. In its broadest context, the strip includes two identical halves, with each half including a mounting portion, an extension portion and a trough. The trough is adapted to extend outwardly over the entrance way of a door. Additionally, the first and second halves of the trough are sloped away from one another to facilitate water drainage away from the door opening. The details of the various components of the present invention, and the manner in which they interrelate, will be described in greater detail hereinafter.

The water diverting strip 20 of the present invention is adapted to be secured over a doorway and functions to divert water therefrom. To achieve this, the strip 20 includes a first side 22 and a second side 24 which are identical to one another. A median 26, or medial portion, is positioned in between the two sides of the strip 20. The first side 22 and second side 24 are identical halves which function to route downwardly falling water away from the door opening. Since the two halves of the strip 20 are identical to one another, only one such half will be described in detail.

More specifically, each side includes a rearward mounting portion 28 defined by a first edge, and a second edge. The rearward mounting portion 28 is substantially planar. Additionally, a number of mounting holes 32 are formed through the thickness of the mounting portion 28 intermediate the first and second edges. These mounting holes 32 are employed in securing the strip 20 to the door jamb of a door way. In the preferred embodiment, the mounting portion 28 is approximately 1 inch in length.

Each side further includes an extension portion 34. This extension portion 34 is defined by a first edge, a second edge, and an intermediate extent therebetween. The first edge of the extension portion 34 is integral with the second edge of the rearward mounting portion 28. In the preferred embodiment, the intermediate extent is approximately 1 inch in length, i.e. from the first to the second edge. This length ensures that the extension portion 34 extends slightly beyond the door jamb of the door way. Furthermore, in order to promote routing of water into the trough 36, the extension portion 34 is sloped downwardly from its first towards its second edge. In this manner, any water hitting the extension portion 34 is delivered into the trough 36.

Figure 2:
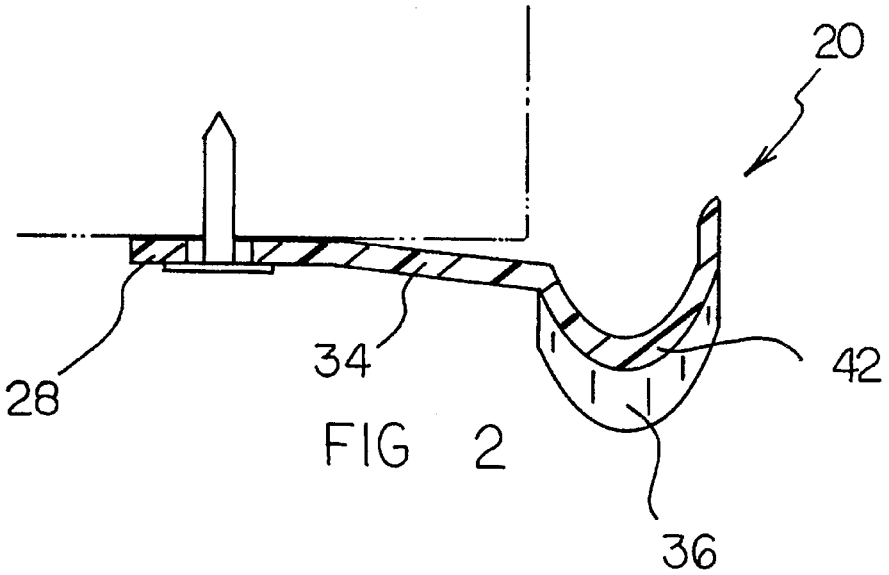
FIG. 2 is a view taken along line 2—2 of FIG. 1.

The trough 36 is defined by a proximal end 38 which is adjacent the median 26 of the strip 20 and a distal end 40 which is opposite the proximal end 38. Additionally, the trough 36 is defined by a first edge, a second edge and an intermediate arcuate extent 42 positioned in between the first and second edges. This arcuate extent 42 forms a water passageway. Furthermore, the trough 36 is angled downwardly from the proximal toward the distal end 40. Through the sloping, or angling of the trough 36, water is delivered to the extreme side portions of the door way and away from the opening of the door way. Additionally, the second edge of the trough 36 is beveled to route water therein. This bevelling is most clearly illustrate in FIG. 2. In the preferred embodiment, the trough 36 is 1 inch in length, i.e. from the first to the second edge.

In use, the strip is affixed to the jamb of a door way. This is achieved by way of screws positioned within the mounting holes of the rearward mounting portions of the strip. The strip is affixed such that the trough portions of the strip are clear of the door jamb and oriented upwardly. In this orientation, the troughs function to route water to the extreme sides of the door way. Although the invention has been described with mounting portions and extension portions which are both 1 inch in length, other lengths can be employed. Whatever lengths are employed, they should be sufficient to allow the trough portions to clear the door jamb. Furthermore, the extension portions are sloped to promote any water fall thereon to be delivered into the trough portions.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water diverting strip adapted to be secured over a doorway to divert water therefrom, the strip comprising in combination:

a single piece body, said body including a first side, a second side and an median formed therebetween, each of the sides comprising;

a rearward mounting portion having a first edge, a second edge, the rearward mounting portion being substantially planar and having a number of mounting holes formed through its thickness intermediate the first and second edges;

an extension portion having a first edge, a second edge, and an intermediate extent therebetween, the first edge of the extension portion being integral with the second edge of the rearward mounting portion, the intermediate extent being approximately 1 inch in length and sloping downwardly from the first edge toward the second edge;

a trough having a proximal end adjacent the median of the strip, a distal end opposite the proximal end, a first edge, a second edge and an intermediate arcuate extent positioned in between the first and second edges, the first edge of the trough being integral with the second edge of the extension portion, the trough being angled downwardly from the proximal end toward the distal end, the intermediate arcuate extent having a cross-section increased from the proximal end towards the opposite distal end, the second edge of the trough being beveled to route water therein;

the troughs of the first and second sides being jointed at the median to form a continuous trough extending from one distal end of one side to the opposite distal end of the other side.

* * * * *